US006251262B1

(12) United States Patent
Hatanaka et al.

(10) Patent No.: US 6,251,262 B1
(45) **Date of Patent: *Jun. 26, 2001**

(54) PROCESS FOR HYDRODESULFURIZATION OF DIESEL GAS OIL

(75) Inventors: Shigeto Hatanaka, Yokohama; Osamu Sadakane, Tokyo; Hideshi Iki, Yokohama, all of (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/377,087

(22) Filed: Aug. 19, 1999

(30) Foreign Application Priority Data

Oct. 5, 1998 (JP) ..... 10-282894

(51) Int. Cl.[7] ..... C10G 65/04; C10G 45/04
(52) U.S. Cl. ..... 208/210; 208/216 R; 208/217
(58) Field of Search ..... 208/210, 216 R, 208/217

(56) References Cited

U.S. PATENT DOCUMENTS

| | | | | |
|---|---|---|---|---|
| 3,239,453 | * | 3/1966 | Halik et al. | 208/210 |
| 3,317,419 | * | 5/1967 | Fortman | 208/97 |
| 3,696,027 | * | 10/1972 | Bridge | 208/210 |
| 3,876,530 | * | 4/1975 | Frayer et al. | 208/210 |
| 4,003,828 | | 1/1977 | Eberly | 208/251 H |
| 4,054,508 | * | 10/1977 | Milstein et al. | 208/89 |
| 4,306,964 | * | 12/1981 | Angevine | 208/210 |
| 4,431,525 | * | 2/1984 | Hensley, Jr. et al. | 208/210 |
| 4,657,663 | * | 4/1987 | Gardner et al. | 208/210 |
| 4,797,195 | * | 1/1989 | Kukes et al. | 208/59 |
| 4,959,140 | * | 9/1990 | Kukes et al. | 208/59 |
| 5,187,133 | * | 2/1993 | Yoshinari et al. | 502/66 |
| 5,292,428 | * | 3/1994 | Harrison et al. | 208/208 R |
| 5,316,658 | | 5/1994 | Ushio et al. | 208/216 R |
| 5,948,239 | * | 9/1999 | Virdi et al. | 208/57 |

FOREIGN PATENT DOCUMENTS

| | | | |
|---|---|---|---|
| 0 736 589 | * | 10/1996 | (EP) . |
| 52-13503 | | 2/1977 | (JP) . |
| 3-281596 | | 12/1991 | (JP) . |
| 5-311179 | | 11/1993 | (JP) . |
| 7-102266 | | 4/1995 | (JP) . |
| 7-197039 | | 8/1995 | (JP) . |

OTHER PUBLICATIONS

"Key Parameters in Deep Hydrodesulfurization of Diesel Fuel", F. van Looij, et al, Applied Catalysis A: General 170 (1998) 1–12.
"Catalysis Review", 24 (3), 343–345 (1982).
High Olefin Content May Limit Cracked Naptha Desulfurization, D.P. Satchell, "The Oil and Gas Journal", Dec. 1, 1975.
"Hydrodesulfurization of Catalytic Cracked Gasoline", S. Hatanaka and M. Yamada, "Industrial & Engineering Chemistry Research", vol. 36, No. 5, pp. 1519–1523 (1997).
"Hydrodesulfurization of Catalytic Cracked Gasoline", S. Hatanaka and M. Yamada, "Industrial & Engineering Chemistry Research", vol. 36, No. 12, pp. 5110–5117 (1997).
"Hydrodesulfurization of Catalytic Cracked Gasoline", S. Hatanaka and M. Yamada, "Industrial & Engineering Chemistry Research", vol. 37, No. 5, pp. 1748–1754 (1998).

* cited by examiner

*Primary Examiner*—Walter D. Griffin
(74) *Attorney, Agent, or Firm*—Paul & Paul

(57) ABSTRACT

Diesel gas oil feedstock with 1–3 wt % sulfur can be hydrodesulfurized to a diesel gas oil with 0.05 wt % or less sulfur and a Saybolt color of +20 or higher, by defining a hydrogenation region in a fixed bed reactor with a first hydrogenation zone for dibenzothiophene, 1-, 2- and 3-methyldibenzothiophenes, a second hydrogenation zone for 4-methyldibenzothiophene and 4,6-dimethyldibenzothiophene and a third hydrogenation zone for thiols, sulfides and other sulfur-containing substances.

7 Claims, No Drawings

PROCESS FOR HYDRODESULFURIZATION OF DIESEL GAS OIL

BACKGROUND OF THE INVENTION

1. Field of the Invention

The present invention relates to a process, for hydrodesulfurization of sulfur-containing diesel gas oil, which comprises a specific combination of specific hydrogenation steps.

2. Description of the Related Art

The cracked diesel gas oil obtained by cracking the heavy oil or the straight run diesel gas oil obtained by distilling crude oil contains sulfur compounds, and the amount is in a range from 1 to 3 wt % as sulfur. When the diesel gas oil containing sulfur compounds is used as a diesel fuel, sulfur compounds will be exhausted in atmosphere as SOx and the environment will be polluted.

Therefore, these diesel gas oils are used as a fuel usually after being hydrodesulfurized to remove sulfur compounds. It is stated that the permissible value for amount of sulfur included in a diesel fuel should be 0.05 wt % or less in the JIS (Japanese Industrial Standard), and large-scale desulfurization arrangements have been constructed to achieve this value and are used. In addition, it is said that it is necessary to decrease the amount of sulfur further with a view to installing a purification catalyst, which reduces $NO_x$ in an automotive exhaust gas, into a diesel car in the future and using a part of the automotive exhaust gas again by circulating it as a part of a diesel fuel. This system is called an EGR system (EGR: Exhaust Gas Recirculation).

A catalyst which consists essentially of cobalt or nickel, and molybdenum supported on an alumina carrier has conventionally been used for the desulfurization of diesel gas oil so far. However, conventional catalysts have problems in that they can hardly desulfurize 4-methyldibenzothiophene and 4,6-dimethyldibenzothiophene, and therefore, in order to lower the sulfur content of the product to the level of 0.05 wt % or less, it is necessary to raise the reaction temperature and the reaction pressure to a very high level, so that the construction costs of the arrangement and the drive costs increase.

As for a process for improving the desulfurization activity for sulfur compounds, a catalyst whose carrier contains phosphorous and boron has been reported in Japanese Unexamined Patent Publication (Kokai) No. 52-13503, and a catalyst to whose carrier zeolite was added has been reported in Japanese Unexamined Patent Publication (Kokai) No. 7-197039. These catalysts have BrΦnsted acid sites and, thus, exhibit high ability to isomerize a methyl group of dimethyldibenzothiophene and to hydrogenate a phenyl group, and high activity to desulfurize 4-methyldibenzothiophene and 4,6-dimethyldibenzothiophene.

However, catalysts whose carriers contain phosphorous, boron or zeolite have drawbacks in that their desulffirization activities for alkylbenzothiophenes and dibenzothiophenes without 4- or 6-alkyl substituent, such as dibenzothiophene, and 1-, 2- or 3-methyldibenzothiophene are inferior to those of conventional catalysts consisting essentially of cobalt and molybdenum on an alumina carrier (F. van Looij et al. Applied Catalysis A: General 170, 1–12 (1998)). Moreover, said catalysts have further drawbacks in that, as they have Brinsted acid sites, they may easily cause a coloring of the oil product and when they are used for an olefin-containing feedstock oil or are used at a high temperature of 350° C. or higher, thiols and sulfides are occasionally generated to decrease the desulfurization ratio. In addition, they have another problem in that olefin elements in a feedstock may be polymerized at BrΦnsted acid sites to generate coke and the deactivation of catalyst may be accelerated. Even if olefins were not included in a feedstock, if sulfur compounds were desulfurized with said catalysts, olefins would be generated in situ, and it would cause an extraction of coke. This can be understood from the view that a coking speed, when thiophene flows into said catalyst, reaches ten times the coking speed reached when olefins or aromatic compounds flow into the catalyst (Catalysis Review, 24, (3), 343 (1982)).

Thus, as these prior arts have many problems and they do not achieve an effective manufacturing of excellent diesel gas oil with low sulfur content when used for the deep desulfurization of diesel gas oil feedstock.

BRIEF SUMMARY OF THE INVENTION

It is an object of the present invention to provide a process for solving the above-mentioned problems and for effectively producing a diesel gas oil product with an extremely low sulfur content, good hue and excellent performances.

It is another object of the present invention to provide a process for producing diesel gas oil by simple means without special equipment and under severe hydrodesulfurization conditions, such as high temperature and pressure, while the generation of coke can be regulated and the catalyst activity can be prolonged.

After intensive researches for solving the above-mentioned problems, the present inventors have found a process for the deep desulfurization of sulfur-containing diesel gas oil, which comprises a specific combination of hydrogenation steps with the use of specific catalysts in a specific amount, and have finally completed the present invention.

The present invention provides a process for the hydrodesulfurization of sulfur-containing diesel gas oil comprising the steps of:

(1) defining a hydrogenation region in a fixed bed reactor with a first hydrogenation zone, a second hydrogenation zone and a third hydrogenation zone sequentially from the upstream of the sulfur-containing diesel gas oil feedstock flow;

(2) hydrodesulfurizing mainly dibenzothiophene and 1-, 2- and 3-methyldibenzothiophenes in the first hydrogenation zone;

(3) hydrodesulfurizing mainly 4-methyldibenzothiophene and 4,6-dimethyldibenzothiophene in the second hydrogenation zone; and (4) hydrodesulfurizing mainly thiols, sulfides, and other sulfur-containing substances in the third hydrogenation zone.

The present invention also provides a process for the hydrodesulfurization of sulfur-containing diesel gas oil comprising the steps of:

(1) defining a hydrogenation region in a fixed bed reactor with a first hydrogenation zone, a second hydrogenation zone, and a third hydrogenation zone sequentially from the entrance of the fixed bed reactor;

(2) passing the sulfur-containing diesel gas oil feedstock through the first hydrogenation zone, the second hydrogenation zone and the third hydrogenation zone sequentially, wherein (a) a catalyst consisting essentially of cobalt and molybdenum supported on a porous carrier containing alumina as a main ingredient is loaded in the first hydrogenation zone in an amount of 20 to 60 vol % based on the total volume of the catalysts used in the first to third hydrogenation zones, (b) a catalyst consisting essentially of nickel and molybdenum supported on a porous carrier containing 85 to 99 wt % of alumina and 1 to 15 wt % of zeolite is loaded in the second hydrogenation zone in an amount of 20 to 60 vol % based on the total volume of said catalysts and (c) a catalyst consisting essentially of cobalt and/or nickel and molybdenum supported on a porous carrier containing alumina as a main ingredient is loaded in the third hydrogenation zone in an amount of 5 to 20 vol % based on the total volume of said catalysts.

This invention further provides a process for the hydrodesulfurization of sulfur-containing diesel gas oil comprising the steps of:

(1) defining a hydrogenation region in a fixed bed reactor with a first hydrogenation zone, a second hydrogenation zone and a third hydrogenation zone sequentially from the entrance of the fixed bed reactor;

(2) passing the sulfur-containing diesel gas oil feedstock through the first, the second and the third hydrogenation zones sequentially to hydrodesulfurize under conditions of a temperature of 320 to 370° C., a pressure of 3 to 15 MPa, an LHSV of 0.5 to 3 $h^{-1}$, and a hydrogen/oil ratio of 1000 to 5000 scfb, wherein (a) a catalyst consisting essentially of cobalt and molybdenum supported on a porous carrier containing alumina as a main ingredient is loaded in the first hydrogenation zone in an amount of 20 to 60 vol % based on the total volume of the catalysts used in the first to third hydrogenation zones, (b) a catalyst consisting essentially of nickel and molybdenum supported on a porous carrier containing 85 to 99 wt % of alumina and 1 to 15 wt % of zeolite is loaded in the second hydrogenation zone in an amount of 20 to 60 vol % based on the total volume of said catalysts and (c) a catalyst consisting essentially of cobalt and/or nickel and molybdenum supported on a porous carrier containing mainly alumina is loaded in the third hydrogenation zone in an amount of 5 to 20 vol % based on the total volume of said catalysts.

In the above-mentioned second or third invention, a catalyst consisting essentially of cobalt-molybdenum, nickel-molybdenum or cobalt-nickel-molybdenum of a $MoO_3$/COO, $MoO_3$/NiO or $MoO_3$/(CoO+NiO) weight ratio of 2.5 to 4.5:1 and respectively supported on a porous carrier containing alumina as a principal ingredient and 0.1–5 wt % of potassium, may be used as a catalyst in the third hydrogenation zone.

Further, in the first to third invention, the hydrodesulfurization may be effected by flowing the petroleum diesel gas oil feedstock through the first, the second and the third hydrogenation zone sequentially to hydrodesulfurize under conditions of a temperature of 320 to 370° C., a pressure of 10 to 15 MPa, an LHSV of 0.5 to 2 $h^{-1}$ and a hydrogen/oil ratio of 1000 to 5000 scfb and recovering the hydrodesulfurized diesel gas oil product may have a sulfur content of 0.005 wt % or less and a hue of a Saybolt color of +20 or higher.

DESCRIPTION OF THE PREFERRED EMBODIMENTS

The inventions will be described in detail by illustrating the embodiments and the effects thereof The present inventors have studied the above-mentioned problems in the conventional techniques, researched and testified various methods, components of the systems, etc. As a result, they found that the hydrodesulfurization of sulfur-containing diesel gas oil feedstock could be performed to obtain a diesel gas oil product with extremely less sulfur content and less coloring by the process of the present invention, which comprises the steps of (1) defining a hydrogenation region in a fixed bed reactor with a first hydrogenation zone, the second hydrogenation zone and the third hydrogenation zone from the upstream, (2) hydrodesulfurizing mainly dibenzothiophene and 1-, 2- and 3-methyldibenzothiophenes in the first hydrogenation zone, (3) hydrodesulfurizing mainly 4-methyldibenzothiophene and 4,6-dimethyldibenzothiophene in the second hydrogenation zone and (4) hydrodesulfurizing mainly thiols, sulfides, and other sulfur-containing substances in the third hydrogenation zone. In other words, the inventors discovered that the hydrodesulfurization for each sulfur-containing compound in the best hydrogenation zone as well as in proper order was the most important thing to effectively desulfurize sulfur-containing diesel gas oil and to obtain a excellent light oil product with an extremely low sulfur content and little coloring. Moreover, by a deep hydrodesulfurization of sulfur-containing diesel gas oil feedstock with a specific catalyst in specific proportion as well under specific hydrodesulfurization conditions, a light oil product with sulfur content of 0.05 wt % or less and an excellent hue of a Saybolt color of +20–+30 can be obtained effectively.

The present inventors found that a most important key point for effective production of desulfurized diesel gas oil with desired excellent properties was to achieve nearly complete hydrodesulfurization, prior to other steps, of alkylbenzothiophenes and dibenzothiophenes with no alkyl group on 4- or 6-position among sulfur-containing compounds in a diesel gas oil feedstock and that, by doing so, an expensive catalyst and severe hydrodesulfurization conditions would not be necessarily demanded in the following steps. Further, if the light oil feedstock were desulfurized to lessen the sulfur content to 0.05 wt % or less, the desulfurization ratios of alkylbenzothiophenes and dibenzothiophenes with no alkyl group on 4- or 6-position could become 99 wt % or higher. Therefore, this process can demonstrate the effect of the present invention to its maximum.

A catalyst for the present invention can be a catalyst with a carrier selected from the group of porous inorganic material such as silica, alumina, magnesia, titania, silica-alumina, alumina-zirconia, alumina-titania, alumina-boria, alumina-chromia, silica-alumina-magnesia, silicaalumina-zirconia, and its active metal component may be selected from the group of the metals of GROUP VIII, consisting of cobalt, nickel, iron, rhodium, palladium, platinum, etc., and of GROUP VI consisting of molybdenum, tungsten, chromium and others or a combination thereof By the process of the present invention, well-known hydrodesulfarization catalysts, for example a catalyst where cobalt and/or nickel and molybdenum or tungsten are supported on the porous carrier, instead of expensive or specific catalysts, may be used effectively. Preferably, it is advantageous to use a catalyst where cobalt and molybdenum are supported on a porous carrier containing alumina as the principal ingredient (it may contain alumina at 95–100 wt % as the principal ingredient, with other ingredient of up to 5 wt %, such as phosphorus, magnesium, and calcium) because said catalysts show the desulfurization activity to alkylbenzothiophenes and dibenzothiophenes with no alkyl group on 4- or 6-site and they can desulfurize more effectively than the other catalysts. Additionally, said catalysts are most excellent because they can also desulfurize 90 wt % or more of 4-methyldibenzothiophene and 4,6-dimethyedibenzothiophene, which are difficult to desulfurize, though the activity is not high. As the catalyst used in the first hydrogenation zone, the catalyst of Co—Mo supported on a porous carrier in an amount of 20 to 60 vol % based on the total volume of the catalyst used in the first to the third zones is the most suitable.

A diesel gas oil feedstock desulfurized in the first hydrogenation zone will flow into the second hydrogenation zone where mainly 4-methyldibenzothiophene, 4,6-dimethyldibenzothiophene will be desulfurized. In the second hydrogenation zone, the catalyst where nickel and molybdenum are supported on the porous carrier of 85 to 99 wt % alumina and 1 to 15 wt % zeolite may be loaded in an amount of 20 to 60 vol % based on the total volume of the catalyst used in the first to third zones. After the main sulfur-containing compounds are hydrodesulfurized mostly in the first and the second hydrogenation zone, thiols and sulfides will be hydrodesulfurized mainly in the third zone. In the third hydrogenation zone, the catalyst where cobalt and/or nickel and molybdenum are supported on the porous carrier containing alumina as the principal ingredient may be loaded in an amount of 5 to 20 vol % based on the total volume of the catalyst used in the first to third zones.

Hydrodesulfurization conditions for each hydrogenation zone may be a temperature of 320 to 370° C., a pressure of 3 to 15 MPa, an LHSV (liquid hourly space velocity) 0.5 to 3 $h^{-1}$, a hydrogen/oil ratio of 1000 to 5000 scfb. As stated above, specific hydrodesulfurization for each specified sulfur-containing compound can be carried out sequentially in the specified zone of the first, the second, and the third hydrogenation zone respectively. As a result, the desulfurization of sulfur-containing petroleum hydrocarbon diesel gas oil can carried out efficiently without any severe hydrodesulfurization conditions or special systems to obtain the diesel gas oil product with a smaller sulfur content and less coloring.

The roles of the catalyst in each hydrogenation zone are as follows. First, the catalyst consisting essentially of cobalt and molybdenum supported on the porous carrier containing mainly alumina may be loaded in the first zone in an amount of 20 to 60 vol % based on said total volume. This catalyst shows high desulfurization activity to sulfur compounds other than 4-methyldibenzothiophene or 4,6-dimethyldibenzothiophenes, that is, dibenzothiophene and 1-, 2- and 3-methyldibenzothiophenes and other sulfur-containing compounds in the diesel gas oil. It is desirable that the filling ratio of this catalyst in the first hydrogenation zone to the total volume of the catalysts in the first to third zones is set so that 70–95 mole % of sulfur compounds other than 4-methyldibenzothiophene or 4,6-dimethyldibenzothiophene can be desulfurized there. If the catalyst ratio in the first hydrogenation zone is small, not only the desulfurization efficiency will worsen but also the deterioration speed of the catalyst in the second hydrogenation zone by coking will grow and it is undesirable. In case that said catalyst ratio of the first hydrogenation zone is too large, the ratio of the catalyst used in the second hydrogenation zone, which consists essentially of nickel and molybdenum supported on the carrier containing 85 to 99 wt % of alumina and 1 to 15 wt % of zeolite will decrease. Because of it, desulfurization of 4-methyldibenzothiophene or 4,6-dimethyldibenzothiophene will hardly be advanced and therefore the deep desulfurization will not be carried out.

In the second hydrogenation zone, a catalyst consisting essentially of nickel and molybdenum supported on a porous carrier containing alumina 85 to 99 wt % and zeolite 1 to 15 wt % may be used in an amount of 20 to 60 vol % based on the total volume of said catalysts. The ratio of alumina and zeolite is more desirably 90 to 97 wt % of alumina and 3 to 10 wt % of zeolite. Even if a carrier does not contain zeolite at all, the merits of the present invention will be obtained in some measure and a higher desulfurization ratio than in the prior arts will be achieved. This catalyst can show high desulfurization activity for 4-methyldibenzothiophene and 4,6-dimethyldibenzothiophene. Thiols and sulfides may be generated, by a side reaction in the second hydrogenation zone. Moreover, the product may color to a small extent depending on reactive conditions.

In the third hydrogenation zone, a catalyst consisting essentially of cobalt and/or nickel and molybdenum supported on the porous carrier containing mainly alumina may be used in an amount of 5 to 20 vol % based on the total volume of said catalysts. In the third hydrogenation zone, the desulfurization of thiol- or sulfide by-products generated in the second hydrogenation zone and the post treatment of the coloring compounds will be carried out. A catalyst ratio of the third hydrogenation zone to the total volume of the catalyst used in the first zone to third zone has only to be sufficient for the desulfurization of thiols and sulfides as well as the processing of the coloring compounds. Moreover, in the third zone, the catalyst of cobalt-molybenum, nickel-molybenum and cobalt-nickel-molybenum of a MoO3/CoO, MoO3/NiO or MoO3/ (CoO+NiO) weight ratio of 2.5 to 4.5:1 and respectively supported on the carrier containing alumina as a principal ingredient and 0.1 to 5 wt % potassium is more effective in the desulfurization of thiols and sulfides. The more desirable content of potassium is in a range of 0.5 to 2.0 wt % and a weight ratio of MoO3/CoO, MoO3/NiO or MoO3/(CoO+NiO) are in a range of 3.0 to 4.0. This depends on the reason why Brbnsted sites on the catalyst greatly decrease by adding potassium to the carrier and therefore the generation of thiols and sulfides on the catalyst in the third zone will possibly be regulated, and the hydrogdesulfurization speed of thiols and sulfides will become a maximum. It has been known that the by-products of thiols and sulfides are generated even in a hydrogenation atmosphere of high pressure, and therefor the desulfurization for these compounds have been needed generally for the improvement of desulfurization ratio (Oil and Gas Journal, 123 D. P. Satchell, Dec. 1 (1975)).

Thus, the process in which the best catalyst for each hydrogenation zone is to be arranged corresponding to the purpose was found to provide a high desulfurization ratio, after the present inventors have researched desulfurization mechanisms and examined the characteristics of catalysts in detail. Thus, the present invention is based on a new idea. In addition, by adding potassium to a carrier, the generation of thiols and sulfides can be regulated, and the hydrodesulfurization speed of thiols as well that of sulfides becomes the maximum by adjusting a $MoO_3$/CoO, $MoO_3$/NiO or $MoO_3$/(CoO+NiO) weight ratio of 2.5 to 4.5 respectively and those was found newly by the present inventors. By applying these findings to the catalyst in the third zone, the desulfurization ratio will become a maximum.

Moreover, the filling ratio of the catalyst in each zone can be decided upon the volume ratio stated by the present invention on considering the composition of sulfur compounds and a sulfur content aimed for the product. The catalyst in the first zone may be in a range of 20 to 60 vol % based on the total volume of the catalysts used in the first to the third zones. The one in the second hydrogenation zone may be in a range of 20 to 60 vol % based on said total volume and the one in the third zone may be in a range of 5 to 20 vol % based on said total volume.

More preferably, the catalyst in the first hydrogenation zone may be in a range of 30 to 50 vol % the total volume of the catalysts used in the first to the third zones. The one in the second hydrogenation zone may be in a range of 40 to 60 vol % based on said total volume and the one in the third hydrogenation zone may be in a range of 5 to 15 vol % based on said total volume.

The active metal content adopted in a conventional desulfurization catalyst for the usual diesel gas oil can be adopted as a active metal content contained in the catalyst used for the present invention. That is, based on 100 weight parts of carrier, Co or Ni active metal may be in a range of 1 to 10 weight parts (calculated as CoO or NiO), preferably in a range of 3 to 6 weight parts and Mo active metal may be in a range of 10 to 30 weight parts (calculated as $MoO_3$), preferably in a range of 15 to 25 weight parts. As for the metal content, when it is low, as the activity will be insufficient, the deactivation kinetics of the catalyst will grow. On the other hand, if too much, as the activity will saturate, it will be uneconomical. As for a ratio of Co or Ni to Mo, the ratio by which the maximum desulfurization activity can be obtained may be adopted. However, when a weight ratio of Co or Ni to Mo of a catalyst in the third zone is so regulated that a $MoO_3$/CoO, $MoO_3$/NiO or $MoO_3$/(CoO+NiO) weight ratio respectively is in a range of 2.5 to 4.5:1, more preferably of 3.0 to 4.0:1, the hydrodesulfurization speed for thiols and sulfides will become the maximum and it will be very effective to improve the desulfurization ratio.

The present invention has such characteristic that a porous carrier containing 85 to 99 wt % of alumina and 1 to 15 wt % of zeolite is used in the second hydrogenation zone. And as the zeolite, A-type zeolite, X-type zeolite, Y-type zeolite, L-type zeolite, MFI-type zeolite, and mordenite, etc. may be used. Above all, USY-type zeolite made by dealuminating Y-type zeolite to improve the heat stability may be used most desirably. These zeolites may be ion-exchanged to generate BroΦsted acid sites. They may also be ion-exchanged by protons, an alkaline earth metal, a rare earth metal, etc.

The zeolite can be followed by calcination, after being molded, by being mixed with a gel of alumina, and can be put on a molded alumina carrier with a binder.

A catalyst containing a small amount of various reforming elements for improvement of the desulfurization activity, etc. can be used as a catalyst in each hydrogenation zone. For instance, it is possibly effective to add phosphorous to the catalyst in the second hydrogenation zone, because it can improve the dispersibility of active metals, as well increase the BrΦnsted acid sites to improve the desulfurization activity to 4-methyldibenzothiophene and 4,6-dimethyldibenzothiophene. However, if phosphorous is added, for producing the excellent product effectively, it is necessary to take the coloring of the products and the deposition of coke into account as well. On the other hand, it is possibly effective to add magnesium to a catalyst in the third hydrogenation zone, because it can decrease the BrΦnsted sites and regulate the generation of thiols and sulfides.

A gas oil applicable to the present invention is a gas oil fraction with a boiling point in a range from 200 to 380° C. such as a straight run gas oil, a catalytic cracking gas oil, and a pyrolysis gas oil. A gas oil hydrogenated once with other arrangements can be desulfurized deeply by the process according to the present invention. Though the present invention may be effective also in the desulfurization of vacuum gas oil with higher boiling point, it is difficult to apply the process of the present invention to the desulfurization of an atmospheric residue which contains a large amount of heavy component, because the deactivation of catalyst in the second hydrogenation zone becomes remarkable.

A permissible sulfur content included in a diesel gas oil feedstock applicable to the present invention is not especially limited, and the content in usual straight-run gas oil is about 1 to 2 wt %. The sulfur content in the diesel gas oil product can be decided arbitrarily if necessary, and a desulfurization ratio needed can be achieved by the optimization of reactive conditions of reaction temperature, pressure, and liquid hourly space velocity (LHSV), hydrogen/oil ratio etc.

A diesel gas oil product desulfurized by the present invention can be used as a regular or a premium diesel fuel for a diesel car. It is natural to be able to mix a lubricant improver, a cetane number improver, and a desiccating agent with the desulfurized oil if necessary. Moreover, it is possible to use the desulfurized oil by mixing with an A-type heavy oil or other oil.

Desulfurization conditions for usual gas oil can be adopted as reactive conditions for the process of the present invention. That is, the conditions can be set from 320 to 370° C. in temperature, 3 to 15 MPa in pressure, 0.5 to 3 $h^{-1}$ in LHSV and 1000 to 5000 scfb in hydrogen/oil ratio according to the desulfurization ratio aimed. Even in case of adopting the usual desulfurization conditions, the possible achievement of high desulfurization ratio is one of main characteristics of this invention.

In addition, the present invention can provide a full performance in desulfurization even at a high pressure. Therefore, when the gas oil fraction feedstock of sulfur-containing hydrocarbon petroleum is passed, to be desulfurized, through the first hydrogenation zone, the second hydrogenation zone, and the third hydrogenation zone sequentially under conditions of a high pressure of 10 to 15 MPa, a temperature of 320 to 370° C., an LHSV of 0.5 to 2 $h^{-1}$, a hydrogen/oil ratio of 1000 to 5000 scfb, a light oil having excellent properties and low pollution, such as a sulfur content of 0.005 wt % or less and a hue of +20 or higher, will be produced as a diesel gas oil product. Pressure ranges used in prior arts have been about 3–7 MPa so far, while the present invention can provide excellent performances even under a higher pressure. Thus, a reaction can be advanced even at a lower temperature than that used in prior arts due to a high pressure of 10 to 15 MPa. It also is possible to make a hydrogenation reaction of aromatic hydrocarbons in a raw gas oil fraction progress advantageously in a thermodynamic equilibrium. Therefore, a content ratio of aromatic hydrocarbons in a product obtained by the present invention is much lower than those obtained by the prior arts, and a diesel gas oil product which exhausts less dark smoke when it being used as a diesel fuel can be obtained. Thus, the present invention, as it can be used even under high pressure, is apparently different from above-mentioned prior arts. The differences can be recognized clearly by the fact that the sulfur content of diesel gas oil product obtained by the present invention is 0.005 wt % or less and the hue thereof is excellent by Saybolt color +20 or higher, while the sulfur content by the prior arts is 0.05 wt %.

A reactor used for the present invention may be a reactor of any known type. For instance, both of fixed bed type reactor and moving bed type reactor or both of a down flow type reactor and an improvement flow type reactor may be acceptable. The most suitable among them is a fixed bed down flow type reactor. This is a reactor type normally used to desulfurize the gas oil, and conventional arrangements can be used as they are. It is not especially needed to provide an independent bed of catalyst for each hydrogenation zone. Though a single reactor divided into plural beds may be applicable generally, plural reactors can be used if necessary. Because there occurs a so-called trickle bed state in which a liquid coexists with a gas under the conditions for deep desulfurization, it is preferable above each catalyst bed to set up the distributor that can uniformly distribute a liquid. Moreover, a quenching hydrogen gas may be introduced into the best location according to the heat situation and the heat can be controlled thereby. Hydrogen gas can be used by recycling after an absorption removal of hydrogen sulfides done by an amine solution. For the actual arrangement, a molded catalyst may be used, and the catalyst may be loaded sock or dense in the reactor by a conventional process. After said catalyst is presulfided in situ, a heated diesel gas oil feedstock with hydrogen can flow into a reactor loaded with the catalyst. A used catalyst may be used repeatedly after the usual baking for reproduction.

The embodiments according to the present invention will be explained here more in detail according to the examples of the present invention.

EXAMPLE 1

A 1 inch inside diameter reaction tube was divided into a first hydrogenation zone, a second hydorgenation zone, and a third hydrogenation zone sequentially from upstream to downstream. In the first zone, 80 mL of a catalyst where 5 wt parts of cobalt (as CoO conversion) and 20 wt parts of molybdenum (as MoO3 conversion) based on 100 wt parts of γ-alumina carrier was supported on a γ-alumina carrier was loaded, in the second zone, 100 mL of a catalyst where 3 wt parts of nickel (as NiO conversion) and 20 wt parts of molybdenum (as MoO3 conversion) were supported on a carrier containing 97 wt % of alumina and 3 wt % of proton-exchanged USY-type zeolite was loaded and, in the third zone, 20 mL of catalyst where 5 wt parts of cobalt (as CoO conversion) and 20 wt parts of molybdenum (as MoO3 conversion) were supported on a γ-alumina carrier was loaded. After these catalysts in the reactor were presulfided by a straight run kerosene containing dimethyldisulfide (sulfur content of 3 wt %) under conditions of 300° C., 5 MPa, LHSV 1 h−1, hydrogen/oil ratio 1000 scfb for 4 hours, Middle East straight run gas oil (boiling point; in a range of 224 to 368° C., sulfur content; 1.41 wt %) was passed into said catalyst to be desulfurized under conditions of 340° C., 5 MPa, LHSV 1 h−1, and hydrogen/oil ratio 1000 scfb. The sulfur content of generation oil (a diesel gas oil product) was 0.035 wt % and the hue was Saybolt color (JISK-2580)+18.

The amount of each sulfur compounds in the effluent from a first, a second and a third hydrogenation zone was measured and desulfurization ratios were calculated. Concerning desulfurization ratios (original feed sulfur basis) of a first hydrogenation zone, the desulfurization ratios of dibenzothiophene and 1-, 2- and 3-methyldibenzothiophenes were over 80%, the desulfurization ratios of 4-methyldibenzothiophene was 45%, and the desulfurization ratios of 4,6-dimethyldibenzothiophene was 25%. Little amount of thiols and sulfides was detected in the effluent from a first hydrogenation zone. Concerning desulfurization ratios (original feed sulfur basis) of first plus second hydrogenation zones, the desulfurization ratios of dibenzothiophene and 1-, 2- and 3-methyldibenzothiophenes were over 95%, the desulfurization ratios of 4-methyldibenzothiophene was 85%, and the desulfurization ratios of 4,6-dimethyldibenzothiophene was 72%. 2 mass ppm of thiols and sulfides was detected in the effluent from a second hydrogenation zone. Concerning desulfurization ratios of total hydrogenation zones, the desulfurization ratios of dibenzothiophene and 1-, 2- and 3-methyldibenzothiophenes were over 99%, the desulfurization ratios of 4-methyldibenzothiophene was 96%, and the desulfurization ratios of 4,6-dimethyldibenzothiophene was 84%. No thiols and sulfides was detected in the effluent from a third hydrogenation zone.

EXAMPLE 2

In the same reaction tube as used in Example 1, the same catalysts as used in the first and the second hydrogenation zone of the reactor in Example 1 were loaded to a first and a second hydrogenation zone in this amount respectively and 20 mL of a catalyst where 4.0 weight parts of cobalt (as CoO conversion) and 20 weight parts of molybdenum (as $MoO_3$ conversion) were supported on a γ-alumina carrier was loaded to a third hydrogenation zone. These catalysts in the reactor were presulfided in the same way as used in Example 1 and the same gas oil feedstock as used in Example 1 was desulfurized under the same conditions as described in Example 1. The sulfur content of generation oil was 0.037 wt % and the hue was Saybolt Color +18.

EXAMPLE 3

In the same reaction tube as used in Example 1, the same catalysts as used in the first and the second hydrogenation zone of the reactor in Example 1 were loaded to a first and a second hydrogenation zone in this amount respectively, and the 20 ml catalyst where 4.5 weight parts of cobalt (as CoO conversion) and 20 weight parts of molybdenum (as $MoO_3$ conversion) were supported on the γ-alumina carrier was loaded to a third hydrogenation zone. These catalysts in the reactor were presulfided by the same way as described in Example 1. Then the same gas oil feedstock as used in Example 1 was desulfurized under the same conditions.

The sulfur content of generation oil was 0.033 wt % and the hue was Saybolt color +20.

EXAMPLE 4

The same catalysts as used in Example 1 were loaded in the same reaction in this amount as described in Example 1. These catalysts in the reactor were sulfurized by the same way as described in Example 1, the same gas oil feedstock as used in Example 1 was passed into the reactor and desulfurized at 360° C. in temperature, 12 MPa in pressure, 1 $h^{-1}$ in LHSV, and 2000 scfb in hydrogen/oil ratio. The sulfur content of generation oil was 0.004 wt % and the hue was Saybolt color +22.

EXAMPLE 5

80 vol % of Middle East straight run gas oil (boiling point; 224–368° C., sulfur content; 1.41 wt %) and 10 vol % of catalytic cracking gas oil (boiling point; 212–345° C., sulfur content; 0.23 wt %), 10 vol % of direct desulfurized decomposition gas oil (boiling point; 181–346° C., sulfur extent; 0.08 wt %) were mixed. This mixed gas oil was passed into the same catalysts in the reactor as used in Example 1 and desulfurized at 350° C. in temperature, 3 MPa in pressure, 1 $h^{-1}$ in LHSV, and 1000 scfb in hydrogen/oil ratio. The sulfur content of generation oil was 0.058 wt % and the hue was Saybolt color +9. The sulfur content of generation oil after this experiment was continued for 30 days was 0.067 wt % and the hue was Saybolt color +15.

Comparative Example 1

In the same reaction tube as used in Example 1, a catalyst where 3 weight parts of nickel (as NiO conversion) and 20 weight parts of molybdenum (as $MoO_3$ conversion) were supported on a carrier which contained 97 wt % γ-alumina and 3 wt % proton exchange USY-type zeolite was loaded in 200 ml. After this carrier being presulfided by the same way as described in Example 1, the same gas oil feedstock as used in Example 1 was desulfurized under the same conditions as described in Example 1. The sulfur content of generation oil was 0.041 wt % and the hue was Saybolt color −5.

Comparative Example 2

In the same reaction tube as used in Example 1, a catalyst where 5 weight parts of cobalt (as CoO conversion) and 20 weight parts of molybdenum (as $MoO_3$ conversion) were supported on a 100 wt % γ-alumina carrier was loaded in 200 ml. After this carrier was presulfided by the same way as described in Example 1, the same gas oil feedstock as used in Example 1 was desulfurized under the same condition as described in Example 1. The sulfur content of generation oil was 0.044 wt % and the Saybolt color was +18.

Comparative Example 3

The same mixture gas oil as used in Example 5 was passed into the same catalyst used in Comparative Example 1 to be desulfurized. The reactive conditions were the same as described in Example 3. The sulfur content of generation oil was 0.061 wt % and the hue was Saybolt color −8. The sulfur content of generation oil after this experiment was continued for 30 days was 0.088 wt % and the hue was Saybolt color −10.

In case that the hydrodesulfurization of petroleum hydrocarbon gas oil fraction containing sulfur is done by the present invention, not only a high desulfurization ratio of product oil can be obtained, but also a long-term stable catalytic activity can be obtained, because the generation of coke can be controlled.

While preferred embodiments of the inventions have been described using specific terms, such a description is for illustrative purpose only, and it is to be understood that changes and variations may be made without departing from the spirit or scope of the following claims.

What is claimed is:

1. A process for the hydrodesulfurization of sulfur-containing diesel gas oil comprising the steps of:

(1) defining a hydrogenation region in a fixed bed reactor with a first hydrogenation zone, a second hydrogenation zone and a third hydrogenation zone sequentially from the upstream of the sulfur-containing diesel gas oil feedstock flow;

(2) passing a sulfur-containing diesel gas oil feedstock through said first, second and third hydrogenation zones sequentially;

(3) hydrodesulfurizing mainly dibenzothiophene and 1-, 2- and 3-methyldibenzothiophenes in the first hydrogenation zone by using a catalyst which consists essentially of cobalt and molybdenum supported on a porous carrier containing alumina as a principal ingredient, and is loaded in the first hydrogenation zone in an amount of 20 to 60 vol % based on the total volume of the catalysts used in the first to third hydrogenation zones;

(4) hydrodesulfurizing mainly 4-methyldibenzothiophene and 4,6 dimethyldibenzothiophene in the second hydrogenation zone by using a catalyst which consists essentially of nickel and molybdenum supported on a porous carrier containing 85 to 99 wt % of alumina and 15 to 1 wt % of zeolite, and is loaded in the second hydrogenation zone in an amount of 20 to 60 vol % based on the total volume of said catalysts; and (5) hydrodesulfurizing mainly thiols, sulfides and other sulfur-containing substances in the third hydrogenation zone by using a catalyst which consists essentially of cobalt and/or nickel and molybdenum supported on a porous carrier containing alumina as a main ingredient, and is loaded in the third hydrogenation zone in an amount of 5 to 20 vol % based on the total volume of the catalysts.

2. A process according to claim 1, wherein said sulfur-containing diesel gas oil feedstock is passed through the first, second and third hydrogenation zones sequentially to be hydrodesulfurized under conditions of a temperature of 320 to 370° C., a pressure of 3 to 15 MPa, an LHSV of 0.5 to 3 $h^{-1}$ and a hydrogen/oil ratio of 1000 to 5000 sctb and a hydrodesulfurized diesel gas oil product with a sulfur content of 0.005 wt % or less and a hue of a Saybolt color of +20 or higher is recovered.

3. A process according to claim 1, wherein a catalyst consisting essentially of cobalt-molybdenum, nickel-molybdenum, or cobalt-nickel-molybdenum of a MoO3/CoO, MoO3/NiO, or MoO3/(CoO+NiO) weight ratio of 2.5 to 4.5:1 and supported on a porous carrier containing alumina as a principal ingredient and 0.1 to 5 wt % of potassium is used as said catalyst in the third hydrogenation zone.

4. A process according to claim 3, wherein said sulfur-containing diesel gas oil feedstock is passed through said first, second and third hydrogenation zones sequentially to be hydrodesulfurized under conditions of a temperature of 320 to 370° C., a pressure of 10 to 15 MPa, an LHSV of 0.5 to 2 $h^{-1}$, a hydrogen/oil ratio of 1000 to 5000 scfb and a hydrodesulfurized diesel gas oil product with a sulfur content of 0.005 wt % or less and a hue of a Saybolt color of +20 or higher is recovered.

5. A process for the hydrodesulfurization of sulfur-containing diesel gas oil comprising the steps of:

(1) defining a hydrogenation region in a fixed bed reactor with a first hydrogenation zone, a second hydrogenation zone and a third hydrogenation zone sequentially from the entrance of the fixed bed reactor; and (2) passing the sulfur-containing diesel gas oil feedstock through said first, second and third hydrogenation zones sequentially to be hydrodesulfurized under conditions of a temperature of 320 to 370° C., a pressure of 3 to 15 MPa, an LHSV of 0.5 to 3 $h^{-1}$ and a hydrogen/oil ratio of 1000 to 5000 scfb, wherein (a) a catalyst consisting essentially of cobalt and molybdenum supported on a porous carrier containing alumina as a main ingredient is loaded in the first hydrogenation zone in an amount of 20 to 60 vol % based on the total volume of the catalysts used in the first to third hydrogenation zones, (b) a catalyst consisting essentially of nickel and molybdenum supported on a porous carrier containing 85 to 99 wt % of alumina and 15 to 1 wt % of zeolite is loaded in the second hydrogenation zone in an amount of 20 to 60 vol % based on the total volume of said catalysts, and (c) a catalyst consisting essentially of cobalt and/or nickel and molybdenum supported on a porous carrier containing mainly alumina is loaded in the third hydrogenation zone in an amount of 5 to 20 vol % based on the total volume of said catalysts.

6. A process according to claim 5, wherein a catalyst consisting essentially of cobalt-molybdenum, nickel-molybdenum, or cobalt-nickel-molybdenum of a $MoO_3$/CoO, $MoO_3$/NiO, or $MoO_3$/(CoO+NiO) weight ratio of 2.5 to 4.5:1 and supported on a porous carrier containing alumina as a principal ingredient and 0.1 to 5 wt % of potassium is used as a catalyst in the third hydrogenation zone.

7. A process according to claim 6, wherein said sulfur-containing diesel gas oil feedstock is passed through said first, second and third hydrogenation zones sequentially to be hydrodesulfurized under conditions of a temperature of 320 to 370° C., a pressure of 10 to 15 MPa, an LHSV of 0.5 to 2 $h^{-1}$ and a hydrogen/oil ratio of 1000 to 5000 scfb and a hydrodesulfurized diesel gas oil product with a sulfur content of 0.005 wt % or less and a hue of a Saybolt color of +20 or higher is recovered.

* * * * *